United States Patent [19]

Chin et al.

[11] Patent Number: 4,889,615

[45] Date of Patent: Dec. 26, 1989

[54] ADDITIVE FOR VANADIUM CAPTURE IN CATALYTIC CRACKING

[75] Inventors: Arthur A. Chin, Cherry Hill; Ivy D. Johnson, Medford, both of N.J.; Charles T. Kresge, Westchester, Pa.; Michael S. Sarli, Haddonfield, N.J.

[73] Assignee: Mobil Oil Corporation, New York, N.Y.

[21] Appl. No.: 280,451

[22] Filed: Dec. 6, 1988

[51] Int. Cl.[4] ..... C10G 11/18

[52] U.S. Cl. ..... 208/113; 208/52 CT; 208/120; 208/121; 208/122; 208/149; 502/521; 423/244

[58] Field of Search ..... 208/120, 113, 121, 122, 208/149, 52 CT; 502/521; 423/244

[56] References Cited

U.S. PATENT DOCUMENTS

| | | | |
|---|---|---|---|
| 4,221,677 | 9/1980 | Vasalos et al. | 502/64 |
| 4,381,991 | 5/1983 | Bertolacini et al. | 208/113 |
| 4,432,890 | 2/1984 | Beck et al. | 208/120 |
| 4,454,244 | 6/1984 | Woltermann | 502/208 |
| 4,465,779 | 8/1984 | Occelli | 502/63 |
| 4,469,589 | 9/1984 | Yoo et al. | 208/120 |
| 4,472,267 | 9/1984 | Yoo et al. | 208/120 |
| 4,497,902 | 2/1985 | Bertolacini et al. | 502/65 |
| 4,513,093 | 4/1985 | Beck et al. | 502/84 |
| 4,515,683 | 5/1985 | Beck et al. | 208/113 |
| 4,519,897 | 5/1985 | DeJong | 208/74 |
| 4,549,958 | 10/1985 | Beck et al. | 208/253 |
| 4,588,702 | 5/1986 | Beck et al. | 502/65 |
| 4,656,156 | 4/1987 | Misra | 502/415 |
| 4,707,461 | 11/1987 | Mitchell et al. | 502/64 |

FOREIGN PATENT DOCUMENTS

| | | | |
|---|---|---|---|
| 0204543 | 12/1986 | European Pat. Off. | 208/52 CT |

OTHER PUBLICATIONS

Manufacturer's brochure: Desox TM FCC Sox Reduction Additive, *Katakistiks.*

Wormsbecher et al., J. Catalysis, 100, 130–137 (1986).

*Primary Examiner*—Anthony McFarlane

*Attorney, Agent, or Firm*—Alexander J. McKillop; Charles J. Speciale; Malcolm D. Keen

[57] ABSTRACT

A catalytic cracking process especially useful for the catalytic cracking of high metals content feeds including resids in which the feed is cracked in the presence of a catalyst additive comprising a dehydrated magnesium-aluminum hydrotalcite which acts as a trap for vanadium as well as an agent for reducing the content of sulfur oxides in the regenerator flue gas. The additive is used in the form of a separate additive from the cracking catalyst particles in order to keep the vanadium away from the cracking catalyst and so preserve the activity of the catalyst.

20 Claims, No Drawings

ADDITIVE FOR VANADIUM CAPTURE IN CATALYTIC CRACKING

FIELD OF THE INVENTION

The present invention relates to a method for mitigating the deleterious effects of vanadium on catalytic cracking. These objectives are achieved by the use of an additive which acts as a trap for vanadium.

BACKGROUND OF THE INVENTION

The catalytic cracking process is widely used in the petroleum refinery industry for the conversion of relatively high boiling point petroleum feedstocks into lower boiling products, especially gasoline. In fact, the catalytic cracking process has become the preeminent process in the industry for this purpose. At present, the fluid catalytic cracking process (FCC) provides the greatest proportion of catalytic cracking capacity in the industry although the moving, gravitating bed process also known as Thermofor Catalytic Cracking (TCC) is also employed. The present invention is primarily applicable to FCC but it may also be employed with TCC.

The increasing necessity faced by the refining industry for processing heavier feedstocks containing higher concentrations of metal contaminants and sulfur presents a number of problems. Sulfur present in the feed tends to be deposited on the catalyst as a component of the coke which is formed during the cracking operation although most of the sulfur passes out of the reactor with the gaseous and liquid products from which it can later be separated by conventional techniques. It is, however, the sulfur containing coke deposits which form on the catalysts which are a particularly prolific source of problems. When the spent catalyst is oxidatively regenerated in the regenerator, the sulfur which is deposited on the catalyst together with the coke is oxidized and leaves the regenerator in the form of sulfur oxides ($SO_2$ and $SO_3$, generically referred to as $SO_x$) together with other components of the flue gas from the regenerator. Because the emission of sulfur oxides is regarded as objectionable, considerable work has been directed to the reduction of sulfur oxide emissions from the regenerators of catalytic cracking units. One method for doing this employs a metal oxide catalyst additive which is capable of combining with the sulfur oxides in the regeneration zone so that when the circulating catalyst enters the reducing atmosphere of the cracking zone again, the sulfur compounds are released in reduced form so that they are carried out from the unit together with the cracking products from which they are subsequently separated for treatment in a conventional manner. The additive is regenerated in the cracking zone and after being returned to the regenerator is capable of combining with additional quantities of sulfur oxides released during the regeneration. U.S. Pat. No. 3,835,031 describes the use of Group II metal oxides for this purpose; U.S. Pat. No. 4,071,436 describes the use of a catalyst additive comprising separate particles of alumina which functions in a similar way and U.S. Pat. No. 4,071,416 proposes the addition of magnesia and chromia to the alumina containing particles for the same purpose. U.S. Pat. Nos. 4,153,534 and 4,153,535 disclose the use of various metal-containing catalyst additives which are stated to be capable of reducing sulfur oxide emissions with cracking catalyst containing CO oxidation promoters.

The use of magnesium aluminate spinels for the reduction of sulfur oxide emissions is described in U.S. Pat. Nos. 4,469,589 and 4,472,267. The spinel catalyst additive is effective in the presence of conventional CO oxidation promoters such as platinum and in addition, a minor amount of a rare earth metal oxide, preferably cerium, is associated with the spinel.

The presence of metal contaminants in FCC feeds presents another and potentially more serious problem because although sulfur can be converted to gaseous forms which can be readily handled in an FCCU, the metal contaminants generally tend to accumulate in the unit. The most common metal contaminants are nickel and vanadium which are generally present in the form of porphyrins or asphaltenes and during the cracking process they are deposited on the catalyst together with the coke formed during the cracking operation. Because both these metals exhibit dehydrogenation activity, their presence on the catalyst particles tends to promote dehydrogenation reactions during the cracking sequence and this results in increased amounts of coke and light gases at the expense of gasoline production. It has been shown that increased coke and hydrogen formation is due primarily to nickel deposited on the catalyst whereas vanadium also causes zeolite degradation and activity loss as reported in *Oil and Gas Journal,* 9 Apr. 1984, 102–111. See also *Petroleum Refining, Technology and Economics,* Second Edition, Gary, J. H. et al, Marcel Dekker, Inc., New York, 1984, pp. 106–107. The mechanism of vanadium poisoning of cracking catalysts is described in the article by Wormsbecker et al in *J. Catalysis* 100, 130–137 (1986). Essentially, the vanadium compounds present in the feed become incorporated in the coke which is deposited on the cracking catalyst and in the regenerator is oxidized to vanadium pentoxide as the coke is burned off. The vanadium pentoxide is then posited to react with water vapor present in the regenerator to form vanadic acid which is capable or reacting with the zeolite catalyst, destroying its crystallinity and reducing its activity.

Because the compounds of vanadium and other metals cannot, in general, be readily removed from the cracking unit as volatile compounds, the usual approach has been to passivate them or render them innocuous under the conditions which are encountered during the cracking process. One passivation method has been to incorporate additives into the cracking catalyst or separate particles which combine with the metals and therefore act as "traps" or "sinks" so that the active zeolite component is protected. The metal contaminants are removed together with the catalyst withdrawn from the system during its normal operation and fresh metal trap is added together with makeup catalyst so as to effect a continuous withdrawal of the deleterious metal contaminants during operation. Depending upon the level of the harmful metals in the feed to the unit, the amount of additive may be varied relative to the makeup catalyst in order to achieve the desired degree of metals passivation. Additives proposed for passivating or trapping various metal poisons include antimony for controlling nickel poisoning, as discussed by Wormbecker op cit, and tin which has been used for processing various high metal feedstocks. Other additives proposed for controlling vanadium include the alkaline earth metal oxides, especially magnesium oxide and calcium oxide (Wormsbecker, op cit) as well as other alkaline earth metal and rare earth compounds e.g. lanthanum and cerium compounds, as described in U.S. Pat. Nos. 4,465,779;

4,519,897; 4,485,184; 4,549,958; 4,515,683; 4,469,588; 4,432,896; and 4,520,120. These materials which are typically in the oxide form at the temperatures encountered in the regenerator presumably exhibit a high reaction rate with vanadium to yield a stable, complex vanadate species which effectively binds the vanadium and prevents degradation of the active cracking component in the catalyst.

For economic reasons, if for no others, it would be advantageous to use a single additive which is effective for both metals and $SO_x$ removal. Unfortunately, however, there appears to be no correlation between activity as a metals passivator and activity as an $SO_x$ trap. For example, alumina which is effective as an $SO_x$ trap as described in U.S. Pat. No. 4,071,436, exhibits poor affinity to interact with vanadium and alkaline earth metal oxides have been reported to lose their activity for sulfur capture if subjected to repeated cycling (see U.S. Pat. No. 4,472,267). For this reason, it has generally been expected that it would be necessary to use two separate traps in order to handle cracking feeds containing high levels of metals as well as significant quantities of sulfur.

SUMMARY OF THE INVENTION

We have now found a solid additive composition which is highly effective for both vanadium passivation and $SO_x$ removal during catalytic cracking operations. We have found that the hydrotalcite compounds are effective for vanadium capture as well as for the removal of sulfur oxides ($SO_x$). The hydrotalcites are therefore capable of serving as a dual functional additive for both metals and $SO_x$ removal. The advantage of this is that if the cracking feed does contain troublesome levels of both sulfur and vanadium, it may be possible to employ the hydrotalcite as a single additive in amounts lower than would be necessary for the total additive concentration if separate additives for vanadium passivation and $SO_x$ removal were employed. Since many additives tend to degrade the selectivity of the cracking process, a lower total additive level is desirable. The feeds which may be cracked in the presence of the present additives will typically include 0.1 to 5.0 weight percent sulfur and at least 2 ppmw vanadium, typically greater than 5 ppmw vanadium e.g. 5–100 ppmw vanadium.

According to the present invention, therefore, a catalytic cracking process for catalytically cracking a heavy petroleum cracking feed containing vanadium and possibly sulfur contaminants is carried out in the presence of a minor amount of an additive comprising a hydrotalcite.

The additive composition is preferably employed as a separate additive to the cracking catalyst, i.e., in the form of particles separate from the particles of the active cracking catalyst, because this is the most effective way of keeping the vanadium away from the active cracking catalyst. It also permits the additive to be added and withdrawn at a rate which is in accordance with the requirements of the feed currently being processed in the unit. This permits the refiner to be responsive to changes and fluctuations in the feedstock as well as to the operating requirements of the unit at any given time which may affect the extent to which vanadium and sulfur exert their harmful effects. Either the active cracking catalyst or the separate additive particles may include other components encountered in catalytic cracking operations, especially carbon monoxide oxidation promoters such as platinum.

The hydrotalcites have the advantage of improved (decreased) coke selectivity in catalytic cracking operations compared with alkaline earth oxides. Although the alkaline earth oxides may, in themselves, be more effective for vanadium capture, the decreased coke selectivity arising from the use of the hydrotalcites is advantageous in commercial FCC operation because, at the constant coke make characteristic of commercial operation, the decreased passivating activity may be overcome by the increased catalyst circulation possible with the decreased coke selectivity. In addition, the hydrotalcites have physical properties which make them more suitable for use as additives in cracking units, especially fluid units.

DETAILED DESCRIPTION

The present invention is employed with catalytic cracking operations in which a high boiling petroleum feed is catalytically cracked to products of relatively lower boiling point, particularly gasoline. The catalytic cracking process is well established and, in general, requires no further description. The use of the present vanadium trap may be employed with any catalytic cracking process in which a cracking catalyst is used in a cyclic operation in which the catalyst is employed in cyclic cracking and oxidative regenerating steps with coke being deposited on the catalyst during the cracking step and removed oxidatively during the regeneration step. During the regeneration step the oxidation of the coke on the catalyst releases heat which is transferred to the catalyst to raise its temperature to the level required during the endothermic cracking step. Thus, the present hydrotalcite additives may be used with both fluid catalytic cracking processes (FCC) and moving, gravitating bed processes (TCC) although they are most readily used as separate particle additives in FCC processes.

The conditions generally employed in catalytic cracking are well established and may generally be characterized as being of elevated temperature appropriate to an endothermic cracking process with a relatively short contact time between the catalyst and the cracking feed. Cracking is generally carried out at temperatures in the range of about 850° to 1200° F. (about 450° to about 650° C.), more usually about 900° to 1050° F. (about 480° to 565° C.) under moderate superatmospheric pressure, typically up to about 100 psia (about 700 kPa), frequently up to about 60 psia (about 415 kPa) with catalyst:oil ratios in the range of about 1:2 to about 25:1, typically 3:1 to about 15:1. These conditions will, however, vary according to the feedstock, the character of the catalyst and the desired cracking products slate. During operation, the catalyst passes cyclicly from the cracking zone to a regeneration zone where the coke deposited on the catalyst during the cracking reactions is oxidatively removed by contacting the spent catalyst with a current of oxygen-containing gas so that the coke burns off the catalyst to provide hot, regenerated catalyst which then passes back to the cracking zone where it is contacted with fresh feed together with any recycle for a further cracking cycle.

The cracking catalysts which are used are solid materials having acidic functionality upon which the cracking reactions take place. The pore size of the solids is sufficient to accommodate the molecules of the feed so that cracking may take place on the interior surfaces of the porous catalyst and so that the cracking fragments may leave the catalyst. Generally, the pore size of the active cracking component will be at least 7 angstroms in order to permit the bulky polycyclic alkylaromatic components of a typical cracking feed to enter the interior pore structure of the zeolite. Current catalytic cracking processes employ zeolitic cracking catalysts, usually containing an active cracking component based on synthetic zeolites having a faujasite structure including, for example, zeolite Y, zeolite USY and rare earth exchanged zeolite Y (REY). Conventionally, the zeolite will be distributed through a porous matrix material to provide superior mechanical strength and attrition resistance to the zeolite. Suitable matrix materials include oxides such as silica, alumina and silica-alumina and various clays. Other catalytic components which participate in cracking reactions may also be present, for example, intermediate pore size zeolites such as zeolite ZSM-5 which have been found to be effective for improving the octane number of the gasoline produced during the cracking. Additional zeolites such as ZSM-5 may be present either in the same catalyst particles as the active cracking catalyst or, alternatively, may be present in separate particles with their own matrix. In FCC operations, it is possible to employ octane improving additives such as ZSM-5 as a separate catalyst additive i.e. on separate particles so as to enable the makeup rate of the cracking catalyst and the octane improver to be separately controlled according to requirements imposed by feed or products slate but in a moving bed (TCC) operation, it will generally be necessary to form a composite of the cracking catalyst and the octane improver in the same catalyst particles or beads since in the large size catalyst beads employed in the moving bed operation, diffusional constraints require the cracking catalyst and the octane improver to be maintained in relatively close proximity for the octane improver to be effective.

Other cracking catalyst additives may also be present either distributed on the particles of the active cracking component e.g. on the matrixed particles of zeolite Y or, alternatively, on separate catalyst particles or on a separate inert support. Additives of this kind may include CO combustion promoters, especially the noble metals such as platinum or palladium as disclosed in U.S. Pat. Nos. 4,072,600 and 4,093,535. Metals which have been stated to have a desirable effect on the reduction of nitrogen oxide emissions from the regenerator such as iridium or rhodium, as described in U.S. Pat. No. 4,290,878 where the iridium or rhodium is present on the same particles as the CO oxidation promoter, may also be used. The use of palladium and ruthenium for promoting CO combusion without causing the formation of excessive amount of nitrogen oxides is described in U.S. Pat. Nos. 4,300,947 and 4,350,615. The use of other systems and additives for promoting CO oxidation in the regenerator is described in U.S. Pat. Nos. 2,647,860, 3,364,136, 3,788,977, and 3,808,121. Such additives and systems may be used in conjunction with the present spinels with the additional additives distributed on the particles of the cracking catalyst or on separate additive particles.

The additive according to the present invention comprises an effective amount of at least one dehydrated hydrotalcite. In the as-synthesized form, hydrotalcites are layered materials with anion exchange properties and have the ideal general formula:

$$M_x^{2+}N_y^{3+}(OH)_{2x+3y-(z+2j)}(A^{k-})_j.nH_2O$$

where

M is a divalent metal such as Mg, Ni, Fe, Zn, Cu,

N is a trivalent metal such as Al, Fe, Cr, and

A is a divalent anion such as $CO_3$ (k=2); or a monovalent anion such as $NO_3$ (k=1); the ratio of x/y is between 1.5/1 to 4/1, $0 \leqq j \leqq 1$ for k=2 and $0 \leqq j \leqq 2$ for k=1, and z=2 (1−j).

The hydrotalcites which find use as cracking catalyst additives are the magnesium-aluminum hydrotalcites (M=Mg, N=Al); in the dehydrated form where n=0 and j is approximately zero, these materials exhibit a strong affinity for anions such as $VO_x^{n-}$ and $SO_x^{n-}$ and therefore provide an effective means for trapping these contaminants.

The hydrotalcites are known materials. Their preparation is described in U.S. Pat. No. 4,656,156 (Misra) and Sato et al. *Ind. Eng. Chem. Prod. Res. Dev.* 25, 89–92 (1986), to which reference is made for a description of these materials and their preparation. Use of hydrotalcites can be advantageous from the point of improved physical properties over the alkaline earth oxides. The hydrotalcites have inherently high mechanical strength (high attrition resistance), high surface area, high porosity, and improved particle size distribution, as described in U.S. Pat. No. 4,656,156 (Misra). In its dehydrated form, the magnesium-aluminum hydrotalcite is mainly amorphous with some MgO. During dehydration water and carbon dioxide (for carbonate anion) are lost; rehydration may occur to give the original hydrotalcite. Dehydration occurs at temperatures between about 350° and 500° C. and during the cracking-regeneration cycle, partial or complete hydration and dehydration may occur, depending principally on conditions in the regenerator. Calcining the Mg/Al hydrotalcites at temperatures greater than 500° C. gives a mixture of MgO and $MgAl_2O_4$, a magnesium aluminate spinel, a material which has been reported to reduce FCC regenerator $SO_x$ emissions (see U.S. Pat. Nos. 4,469,589 (Yoo) and 4,472,267 (Yoo). The activity of the dehydrated hydrotalcite is, however, significantly different than that observed for the spinel, MgO, or mixtures of both. No evidence of MgAl381 $_2O_4$ is observed in the regenerated hydrotalcite, indicating that the spinel is not the active component.

The hydrotalcite is used in its dehydrated form as the cracking catalyst additive. It may be used on its own or, less preferably, composited with a matrix material such as silica, magnesia or another oxide. The use of a matrix material is not preferred because the hydrotalcite has, as noted above, a combination of physical properties which render it highly suitable for use as a vanadium-passivating additive for catalytic cracking use, especially in FCC units. The possession of high porosity is a highly desirable attribute since, as noted by Wormsbecker, the partial molar volume of $Mg_2V_2O_7$ is approximately eight times that of MgO so that if the vanadium trapping reaction implicates the formation of the magnesium vanadate species, a large pore, high pore volume, high surface area material is favored. The addition of a matrix material with a less favorable pore structure is therefore not preferred. If, however, a matrix is used, it will generally constitute up to about 50 weight percent of the total additive composition.

The hydrotalcite may be prepared as an FCC catalyst additive by conventional procedures such as spray drying a slurry of gel of the crystallized hydrotalcite, followed by calcination of the spray-dried spheres to convert the hydrotalcite to its dehydrated form. The particle size of the additive should accord with that of the cracking catalyst, typically up to 300 microns in diameter, more usually 50–100 microns.

The amount of the additive combination used in the circulating catalyst inventory should be related to the content of both the vanadium and sulfur in the FCC feed. Thus, as the content of vanadium increases, the amount of the hydrocalcite additive circulating in the catalyst inventory is increased accordingly in order to trap the vanadium effectively; similarly, as the amount of sulfur in the FCC feed increases, the amount of the additive combination should be increased in order to maintain the $SO_x$ emissions from the regenerator stack within the requisite limits. However, because the additive acts as a trap for both vanadium and as a sulfur oxides emission regulator, it is not necessary that the amount of additive should be related to the sum of the vanadium and sulfur contents in the feed. Rather, the amount of additive circulating in the catalyst inventory should be adjusted according to the higher control requirement, be it the sulfur or the vanadium. Thus, if the feed contains relatively high amounts of sulfur and relatively low amounts of vanadium, the amount of additive should accord with the sulfur content of the feed and conversely, if the feed is relatively high in vanadium and low in sulfur, the amount of additive should be adjusted in order to passivate the vanadium effectively. By using the additive as a trap for vanadium as well as to control sulfur emissions from the regenerator, the makeup rate for the active cracking catalyst is effectively reduced since the vanadium is retained on the particles of the additive so that it cannot exert its deactivating effect on the cracking component. At the same time, gasoline selectivity will be improved and selectivity to hydrogen, dry gas and coke will also improve and sulfur emissions from the stack will be reduced.

Typically, the additive will comprise at least 1 weight percent of the circulating inventory and generally will not exceed 25 weight percent of it. Normally the amount of additive will be from about 2 to 25, more usually 5 to about 20 weight percent of the total circulating inventory.

As noted above, the use of a vanadium trapping additive in the form of separate particles is desirable because not only does the capture of the vanadium on the particles separate from the active cracking component or other active zeolite component keep the vanadium away from the zeolite so as to mitigate the destructive effect on the zeolite but, in addition, catalyst and additive management is facilitated because the vanadium passivating additive can be added at greater or lesser rates depending upon the vanadium content of the feed. Thus, the composition of the circulating inventory of catalyst and additive can be varied by varying the relative makeup rates of the cracking catalyst and the additive. Control of the relative addition and withdrawal rates of the vanadium passivating additive therefore provides an effective method for controlling circulatory inventory composition.

EXAMPLE 1

This example illustrates the preparation of the dehydrated hydrotalcite. A dehydrated hydrotalcite was made by means of the method described in the literature (Sato et al Ind. Eng. Chem. Prod. Res. Dev. 25, 89–92 (1986)). Aqueous solutions of $Al(NO_3)_3$ (186 g in 1000 g $H_2O$), $Mg(NO_3)_2$ (378 g in 100 g $H_2O$), and $Na_2CO_3$ (11 g in 500 g $H_2O$) were stirred together. The pH was raised to 10 with NaOH and stirring continued for 1 hour. The resulting gel was filtered, washed with $H_2O$, filtered and air-dried. The powder was suspended in $H_2O$ (5 g $H_2O$/g solid) and crystallized in 4 static autoclaves at 150° C. for 72 hours at autogenous pressures. The product was filtered, washed with $H_2O$, and air-dried for subsequent characterization. The x-ray diffraction pattern agreed with the published pattern of a Mg/Al hydrotalcite, as reported by Sato, op cit. The elemental composition is shown in Table 1 below.

TABLE 1

| Mg/Al Hydrotalcite Composition | |
|---|---|
| Mg | 16.0 wt % |
| $Al_2O_3$ | 12.0 wt % |
| $CO_3$ | 4.7 wt % |
| Na | 0.01 wt % |
| Ash @ 1000° C. | 51.45 wt % |

This material was dehydrated at 500° C. for 10 hours and cooled in a desiccator. The x-ray pattern matched with the published pattern of a dehydrated hydrotalcite, which shows some MgO.

EXAMPLE 2

A hydrotalcite similar to that described in Example 1 was synthesized by stirring the precipitated gel at 100° C. for 6 hours instead of crystallizing it in an autoclave.

EXAMPLE 3

Fresh Davison RC-25 (trademark - commercial REY cracking catalyst) was steamed at 1450° F. for 10 hours in a 45/55 stream/air mixture at 1 atm pressure. This procedure is used to simulate the catalyst at equilibrium. Catalyst activity was measured in a fixed-fluidized bed FCC unit (850° F. (455° C.), 2:1 catalyst:oil (wt.), 5 min-on-stream, Light East Texas gas oil feed). The results of the test are given in Table 2 below.

EXAMPLE 4

A physical blend of Davison RC-25 and $V_2O_5$ (added to give 5000 ppm V) was steamed under the same conditions described in Example 3. This procedure simulates catalyst deactivation by vanadium. The extent of vanadium poisoning was determined in the bench unit test described in Example 3 and the results are given in Table 2 below.

EXAMPLE 5

A blend containing 15 wt % dehydrated hydrotalcite, as described in Example 1, and 85 wt % Davison RC-25 was mixed with $V_2O_5$ (to give 5000 ppm V). The mixture was steamed and tested under the same conditions described in Example 3 to determine the effect of vanadium on the catalyst in the presence of the hydrotalcite as a passivator. The catalytic activity of the blend was then measured in the bench unit test. The results of the test are given in Table 2.

EXAMPLES 6 through 9

CaO, MgO, a pure $MgAl_2O_4$ spinel, and a 50/50 $MgO/MgAl_2O_4$ mixture were mixed in the same proportions as described in Example 5 with Davison RC-25 and $V_2O_5$. The mixtures were steamed and tested under the same conditions as described in Example 3. The results of these tests are also given in Table 2.

TABLE 2

| FCC Fixed-Fluidized Bed Unit Testing | | | | | |
|---|---|---|---|---|---|
| Example | Additive | V Level (ppm) | Conversion (vol) | C on Spent Catalyst (wt) | Coke Selectivity |
| 3 | None | 0 | 81.8 | 1.26 | 0.281 |
| 4 | None | 5000 | 56.4 | 0.57 | 0.438 |
| 5 | 15% Hydrotalcite | 5000 | 68.2 | 0.64 | 0.296 |
| 6 | 15% CaO | 5000 | 73.8 | 1.05 | 0.363 |
| 7 | 15% MgO | 5000 | 74.5 | 1.04 | 0.357 |
| 8 | 15% $MgAl_2O_4$ | 5000 | 47.3 | 0.36 | 0.405 |
| 9 | 15% MgO/ $MgAl_2O_4$ | 5000 | 72.5 | 0.92 | 0.350 |

Coke Selectivity = C on Spent/(Conv/100 − Conv)
Conversion = Vol % feed converted to 430° F.−(221° C.−) products The results reported in Table 2 above show that the hydrotalcite additive reduces the coke selectivity in the presence of high levels of vanadium to a level comparable to that where no vanadium or additive is present; the other additives are rather less effective. In particular, the improved coke selectivity compared to that of magnesium aluminate to spinel, either alone or mixed with magnesia (Examples 8, 9) should be noted.

We claim:

1. A catalytic cracking process for the conversion of a high boiling hydrcarbon feedstock containing a vanadium contaminant by circulating a cracking catalyst in a cracking zone, a disengaging zone and a regeneration zone, contacting the feedstock in the cracking zone under catalytic cracking conditions with a solid, particulate cracking catalyst to produce cracking products of lower molecular weight while depositing carbonaceous material on the particles of cracking catalyst, separating the particles of cracking catalyst from the cracking products in the disengaging zone and oxidatively regenerating the cracking catalyst by burning off the deposited carbonaceous material in a regeneration zone, in which the cracking is carried out in the presence of solid particles of an additive composition comprising at least one magnesium-aluminum hydrotalcite which is present in an amount sufficient to passivate the vanadium from the feed.

2. A process according to claim 1 in which the hydrotalcite in the as-synthesized form has the formula:

$$Mg_xAl_y(OH)_{2x+3y-(z+2j)}(A^{k-})_j.nH_2O$$

where

A is a divalent anion (k=2); or a monovalent anion (k=1); the ratio of x/y is between 1.5/1 to 4/1, $0 \leqq j \leqq 1$ for k=2 and $0 \leqq j \leqq 2$ for k=1, and z=2 (1−j).

3. A process according to claim 1 in which the hydrotalcite is in the dehydrated form.

4. A process according to claim 2 in which the hydrotalcite is in the dehydrated form produced by heating hydrated hydrotalcite to a temperature between 350° and 500° C.

5. A process according to claim 1 in which the additive is present in the form of particles separate from the particles of the cracking catalyst.

6. A process according to claim 1 in which the additive is present in an amount from 2 to 25 weight percent of the cracking catalyst.

7. A process according to claim 1 carried out as a fluid catalytic cracking operation in which the cracking catalyst is a fluid catalytic cracking catalyst and the additive is present in the form of fluidisable particles separate from the particles of the fluid catalytic cracking catalyst.

8. A process according to claim 7 in which the feed contains vanadium and sulfur contaminants and the additive is present in an amount which is effective to passivate the vanadium from the feed and to reduce the amount of sulfur oxides in flue gas from the regeneration zone.

9. A process according to claim 7 in which the additive is present in an amount from 2 to 25 weight percent of the cracking catalyst.

10. A process according to claim 7 in which the particles of the additive have a particle size from 50 to 300 microns.

11. In a fluid catalytic cracking process in which a hydrocarbon feedstock containing a vanadium contaminant in an amount of at least 5 ppmw is cracked under fluid catalytic cracking conditions with a solid, particulate cracking catalyst to produce cracking products of lower molecular weight while depositing carbonaceous material on the particles of cracking catalyst, separating the particles of cracking catalyst from the cracking products in the disengaging zone and oxidatively regenerating the cracking catalyst by burning off the deposited carbonaceous material in a regeneration zone, the improvement comprising reducing the make-up rate of the cracking catalyst by carrying out the cracking in the presence of a particulate additive composition for passivating the vanadium content of the feed, comprising a dehydrated magnesium-aluminum hydrotalcite.

12. A process according to claim 11 in which the hydrotalcite in the as-synthesized form has the formula:

$$Mg_xAl_y(OH)_{2x+3y-(z+2j)}(A^{k-})_j.\ H_2O$$

where

A is a divalent anion (k=2); or a monovalent anion (k=1); the ratio of x/y is between 1.5/1 to 4/1, $0 \leqq j \leqq 1$ for k=2 and $0 \leqq j \leqq 2$ for k=1, and z=2 (1−j).

13. A process according to claim 11 in which the hydrotalcite is in the dehydrated form.

14. A process according to claim 12 in which the hydrotalcite is in the dehydrated form produced by heating hydrated hydrotalcite to a temperature between 350° and 500° C.

15. A process according to claim 11 in which the additive is present in the form of particles separate from the particles of the cracking catalyst.

16. A process according to claim 11 in which the additive is present in an amount from 2 to 25 weight percent of the cracking catalyst.

17. A process according to claim 11 carried out as a fluid catalytic cracking operation in which the cracking catalyst is a fluid catalytic cracking catalyst and the additive is present in the form of fluidisable particles separate from the particles of the fluid catalytic cracking catalyst.

18. A process according to claim 17 in which the feed contains vanadium and sulfur contaminants and the additive is present in an amount which is effective to passivate the vanadium from the feed and to reduce the amount of sulfur oxides in flue gas from the regeneration zone.

19. A process according to claim 17 in which the additive is present in an amount from 2 to 25 weight percent of the cracking catalyst.

20. A process according to claim 17 in which the particles of the additive have a particle size from 50 to 300 microns.

* * * * *